US008622714B2

(12) United States Patent
Andrews

(10) Patent No.: US 8,622,714 B2
(45) Date of Patent: Jan. 7, 2014

(54) PRESSURE EXCHANGER

(75) Inventor: William T. Andrews, Paget (BM)

(73) Assignee: Flowserve Holdings, Inc., Irving, TX (US)

( * ) Notice: Subject to any disclaimer, the term of this patent is extended or adjusted under 35 U.S.C. 154(b) by 287 days.

(21) Appl. No.: 13/079,038

(22) Filed: Apr. 4, 2011

(65) Prior Publication Data

US 2011/0176936 A1 Jul. 21, 2011

Related U.S. Application Data

(63) Continuation-in-part of application No. 12/092,970, filed as application No. PCT/GB2006/004236 on Nov. 14, 2006, now Pat. No. 8,308,444.

(51) Int. Cl.
*F02C 3/02* (2006.01)

(52) U.S. Cl.
USPC ..... 417/64; 60/39.45

(58) Field of Classification Search
USPC ..... 417/64; 60/39.45
See application file for complete search history.

(56) References Cited

U.S. PATENT DOCUMENTS

| | | | | |
|---|---|---|---|---|
| 2,630,975 | A | 3/1953 | Horth | |
| 3,078,034 | A * | 2/1963 | Spalding | 417/64 |
| 3,431,747 | A * | 3/1969 | Hashemi et al. | 62/123 |
| 3,489,159 | A | 1/1970 | Chang et al. | |
| 3,506,276 | A * | 4/1970 | Petersen et al. | 277/364 |
| 3,754,842 | A * | 8/1973 | Schlanzky | 417/269 |
| 4,269,570 | A * | 5/1981 | Rao | 417/64 |
| 4,887,942 | A | 12/1989 | Hauge | |
| 5,306,428 | A | 4/1994 | Tonner | |
| 5,797,429 | A | 8/1998 | Shumway | |
| 6,205,960 | B1 | 3/2001 | Vallejos | |
| 6,537,035 | B2 * | 3/2003 | Shumway | 417/64 |
| 6,540,487 | B2 * | 4/2003 | Polizos et al. | 417/65 |
| 6,659,731 | B1 * | 12/2003 | Hauge | 417/64 |

(Continued)

FOREIGN PATENT DOCUMENTS

| | | |
|---|---|---|
| GB | 1470956 | 4/1977 |
| WO | 2004/111509 A1 | 12/2004 |

OTHER PUBLICATIONS

International Search Report and Written Opinion dated Oct. 5, 2011, and relating to International Application No. PCT/US2011/042923.
Office Action related to Indian Patent Appln. No. 2999/CHENP/2008 dated Nov. 11, 2012.

*Primary Examiner* — Charles Freay
*Assistant Examiner* — Christopher Bobish
(74) *Attorney, Agent, or Firm* — Dinsmore & Shohl LLP

(57) ABSTRACT

A pressure vessel provided with a first port acting as a high pressure inlet of a first stream and a second port acting as a high pressure outlet. A rotatable valve element is located in the center of the machine. In operation, a fluid stream is introduced to the machine at high pressure where it then passes through the open ports of the valve element and into flow distributor causing upward displacement of a first duct piston, resulting in pressurization and flow of a second fluid. At the same time the second fluid is introduced to the machine at low pressure and flows into the pressure exchange duct, causing downward displacement of a second duct piston and resulting in flow of the first fluid below the duct piston, which then flows into the lower flow distributor, into the valve element, and then out of the pressure vessel.

15 Claims, 13 Drawing Sheets

(56) References Cited

U.S. PATENT DOCUMENTS

| | | | | |
|---|---|---|---|---|
| 6,773,226 | B2 * | 8/2004 | Al-Hawaj | 415/116 |
| 7,214,315 | B2 * | 5/2007 | Shumway | 210/321.66 |
| 7,815,421 | B2 * | 10/2010 | Bross et al. | 417/64 |
| 2006/0032808 | A1 * | 2/2006 | Hauge | 210/321.65 |
| 2006/0054223 | A1 | 3/2006 | Baumgarten et al. | |
| 2006/0213207 | A1 | 9/2006 | Redlich | |
| 2007/0212231 | A1 * | 9/2007 | Bross et al. | 417/65 |

* cited by examiner

PRESSURE EXCHANGER

CROSS-REFERENCE TO RELATED APPLICATION

This application is a continuation in part of application Ser. No. 12/092,970, filed Nov. 11, 2008 now U.S. Pat. No. 8,308,444 that was based on PCT Application PCT/GB2006/004236 filed Nov. 14, 2006.

BACKGROUND OF THE INVENTION

The present invention relates to a pressure exchanger machine. The preferred embodiments disclosed below utilize fixed exchange ducts and a rotary valve element.

Such pressure exchangers are sometimes called 'flow-work exchangers' or 'isobaric devices' and are machines for exchanging pressure energy from a relatively high pressure flowing fluid system to a relatively low pressure flowing fluid system. The term fluid as used herein includes gases, liquids and pumpable mixtures of liquids and solids.

In processes where a fluid is made to flow under pressure, only a relatively small amount of the total energy input is consumed in the pressurizing of the fluid, the bulk of the energy being consumed in maintaining the fluid in flow under pressure. For this reason, continuous flow operation requires much greater energy consumption than non-flow pressurization. In summary, the power required to maintain flow under pressure is proportional to the mass flow rate multiplied by the increase in pressure.

In some industrial processes, elevated pressures are required in certain parts of the operation to achieve the desired results, following which the pressurized fluid is depressurized. In other processes, some fluids used in the process are available at high pressures and others at low pressures, and it is desirable to exchange pressure energy between these two fluids. As a result, in some applications, great improvement in economy can be realized if pressure exchange can be efficiently transferred between two fluids.

By way of illustration, there are industrial processes where a catalyst is utilized at high pressure to cause a chemical reaction in a fluid to take place and, once the reaction has taken place, the fluid is no longer required to be at high pressure, rather a fresh supply of fluid is required at high pressure. In such a process, a pressure exchanger machine can be utilized to transfer the pressure of the reacted high pressure fluid to the fresh supply of fluid, thus improving the economy of the process, by requiring less pumping energy be supplied.

Another example where a pressure exchange machine finds application is in the purification of saline solution using the reverse osmosis membrane process. In this process, an input saline solution stream is continuously pumped to high pressure and provided to a membrane array. The input saline solution stream is continuously divided by the membrane array into a super saline solution (brine) stream which is still at relatively high pressure and purified water stream at relatively low pressure. While the high pressure brine stream is no longer useful in this process as a fluid, the flow pressure energy that it contains has a high value. A pressure exchange machine is employed to recover the flow pressure energy in the brine stream and transfer it to an input saline solution stream. After transfer of the pressure energy from the brine stream, the brine is expelled at low pressure to drain by the low pressure input saline solution stream. Thus, the use of the pressure exchanger machine reduces the amount of pumping energy required to pressurize the input saline solution stream.

Accordingly, pressure exchanger machines of varying designs are well known in the art.

U.S. Pat. No. 4,887,942, as modified by U.S. Pat. No. 6,537,035, teaches a pressure exchanger machine for transfer of pressure energy from a liquid flow of one liquid system to a liquid flow of another liquid system. This pressure exchanger machine comprises a housing with an inlet and outlet duct for each liquid flow, and a cylindrical rotor arranged in the housing and adapted to rotate about its longitudinal axis. The cylindrical rotor is provided with a number of passages or bores extending parallel to the longitudinal axis and having an opening at each end. A piston or free piston may be inserted into each bore for separation of the liquid systems. The cylindrical rotor may be driven by a rotating shaft or by forces imparted by fluid flow. Since multiple passages or bores are aligned with the inlet and outlet ducts of both liquid systems at all times the flow in both liquid systems is essentially continuous and smooth. High rotational and thus high cyclic speed of the machine can be achieved, due to the nature of the device, with a single rotating moving part, which in turn inversely reduces the volume of the passages or bores in the rotor, resulting in a compact and economical machine.

U.S. Pat. Nos. 3,489,159, 5,306,428, 5,797,429 and WO-2004/111,509 all describe an alternative arrangement for a pressure exchanger machine, which utilizes one or more fixed exchanger vessels, with various valve arrangements at each end of such vessel(s). These machines have the advantage of there being no clear limit to scaling up in size and, with the device of WO-2004/111,509, leakage between the high pressure and low pressure streams can be minimized. A piston may be inserted into each exchanger vessel for separation of the liquid systems.

Disadvantages of pressure exchange machines based upon U.S. Pat. No. 4,887,942 can include:

that for high flow rates it is necessary to increase the size of the cylindrical rotor, and there are limitations on the amount that such a rotor can be scaled up as the centrifugal forces will attempt to break apart the rotor, similar to the problems encountered in scaling up flywheels to large sizes and speeds;

that very small clearances are required between the cylindrical rotor ends and the inlet and outlet ducts to maintain low rates of leakage between the high pressure and low pressure fluid systems, with such leakage causing a reduction in efficiency and it being difficult to maintain such small clearances;

that when operated at relatively high rotational speeds, it may not be practical to utilize a driven shaft to control rotation of the rotor, rather by non-linear forces imparted by fluid flow which can reduce the flow range over which a given device can operate efficiently; and that when operated at relatively high rotational speeds, it may not be practical to utilize a piston in the passages in the rotor, thus reducing efficiency by increasing mixing between the two fluid streams.

Disadvantages of pressure exchange machines based upon U.S. Pat. No. 3,489,159 can include:

that the flow in both fluid systems is not essentially continuous and smooth unless a large number of exchanger vessels are utilized;

that these devices are generally limited to low cyclic speeds due to the linear or separated nature of the valves, thus requiring relatively large volume exchanger vessels, which increases cost and size; and that due to the multiple moving parts, these devices tend to be more complex and expensive to manufacture than devices based upon U.S. Pat. No. 4,887,942.

The inventor has also discovered that there remains a need to provide a pressure exchanger that has improved leakage prevention features between adjacent sealing surfaces that make up or cooperate with the rotary valve. He discovered that improved sealing may be achieved by placing the sealing surfaces in a planar radial form to allow axially adjustable clearance, rather than circumferentially where clearance cannot be adjusted.

SUMMARY OF THE INVENTION

The present invention seeks to provide an improved pressure exchanger.

According to an aspect of the present invention, there is provided a pressure exchanger machine for exchanging pressure in a flow stream at relatively high pressure to a second flow stream at relatively low pressure, including:

a rotary valve element for directing and isolating flows;

first and second exchange ducts separate from the rotary valve element; and a pressure vessel arranged to provide first and second compartments for hydraulically connecting high or low pressure flows to the valve element.

Advantageously, there is provided a single valve element. The provision of a single valve element reduces complexity of the exchanger while improving operability thereof.

In the preferred embodiments, the valve element includes first and second valves on a common driven rotating shaft. This has the benefit that the axial hydraulic forces are substantially balanced and the two valves operate substantially synchronously.

Advantageously, the machine includes fixed exchange ducts which are not part of a rotating component. This has the benefit that the machine can be scaled up in size to accommodate very high flows.

Advantageously, in the preferred embodiments the machine is provided with a plurality of exchange ducts. This allows the machine to provide substantially continuous and smooth flow in both fluid systems.

The exchanger is preferably provided with sealing surfaces on or adjacent to the rotating valve part, in order to reduce leakage between the different fluid systems of the machine. Such sealing surfaces can be circumferential axial or planar radial orientated, with the latter orientation advantageously having the ability to adjust the sealing clearances by, for example, using a threaded nut on the shaft to adjust the axial positions of the rotating valve parts, and, advantageously such surfaces could also act as hydrostatic or hydrodynamic axial thrust bearings allowing for the elimination of external thrust bearings.

The exchanger may be provided with one or more pistons in each exchange duct to reduce mixing between the different fluid systems.

The preferred embodiments can provide a pressure exchanger machine which can be scaled up in size to accommodate very high flow; can provide substantially continuous and smooth flow in both fluid systems; can utilize a single rotating valve element for switching flows to the exchange ducts to reduce complexity and leakage between the two fluid systems; can have relatively high rotational speed of the valve element to reduce exchange duct volume requirements; can have a driven rotating shaft on the valve element to allow a wide flow range over which the machine can operate efficiently; can have substantially balanced hydraulic forces on the valve element to reduce bearing requirements; can have minimal leakage between the high pressure and low pressure fluid systems; and can allow for optional use of piston(s) in the exchange ducts to reduce mixing between the different fluid systems; while ensuring reliability, efficiency, economy and maintainability of the machine.

According to another aspect of the present invention, there is provided a method of exchanging pressure between different fluid flows, including the steps of providing a pressure exchanger machine including a plurality of exchange ducts mounted on a non-rotating part of the machine; a rotating valve element or elements; and a pressure vessel surrounding the exchange ducts and including first and second compartments and inlet and outlet flow connections; providing for the passage of high or low pressure flows to or from the compartments through the exchange ducts by means of the valve element or elements; and adjusting the fluid flows so as to adjust the pressure exchange effected by the machine by rotating the valve element or elements while keeping the exchange ducts still.

BRIEF DESCRIPTION OF THE DRAWINGS

Embodiments of the present invention are described below, by way of example only, with reference to the accompanying drawings, in which.

DETAILED DESCRIPTION OF THE INVENTION

Figure 1:
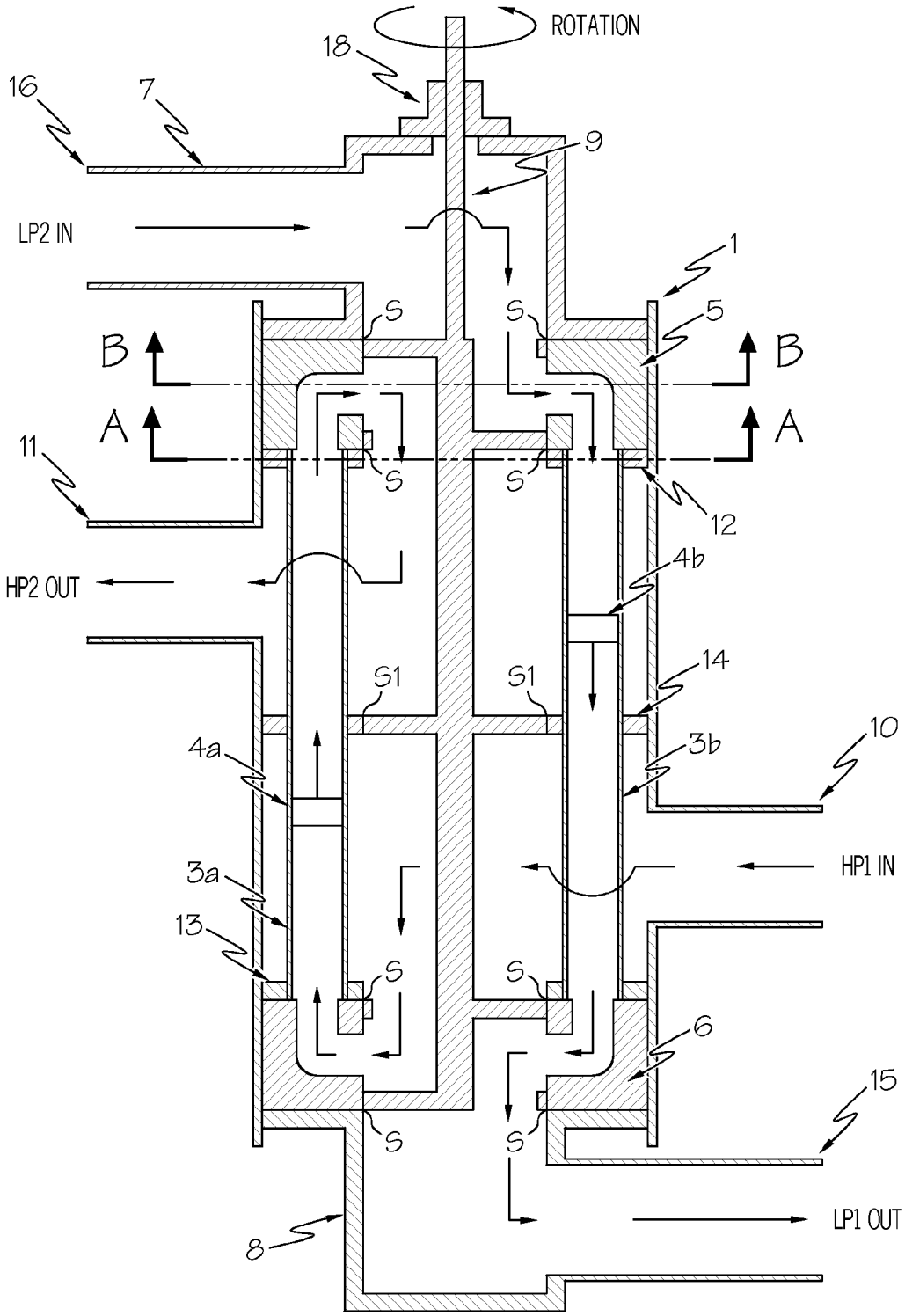
FIG. 1 is a cross-sectional view in simplified form of an embodiment of the exchanger.

Referring first to FIG. 1, a simplified embodiment of the pressure exchange machine in accordance with the present invention is generally shown.

Figure 2A:
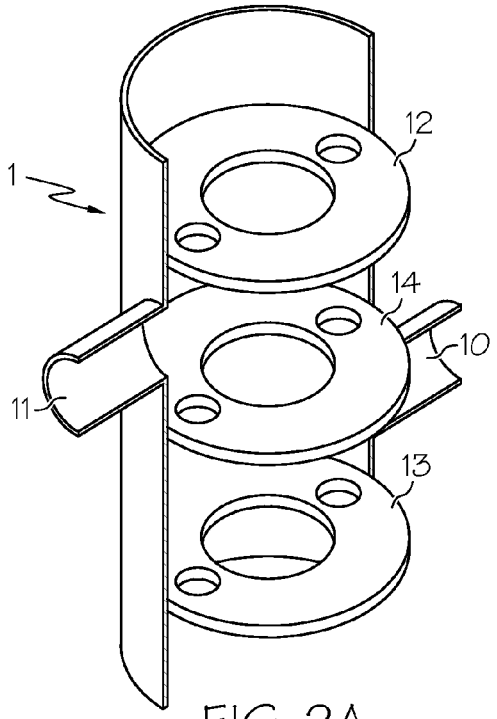
FIG. 2*a* is a perspective view of the pressure vessel of FIG. 2.
Figure 2:
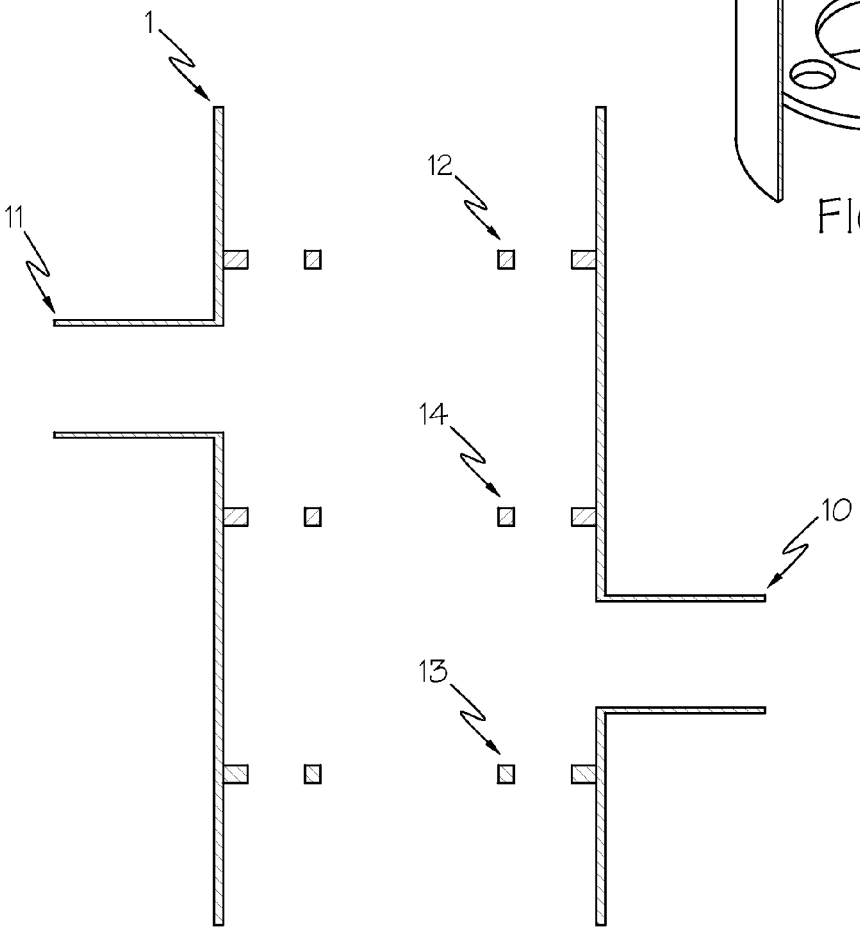
FIG. 2 is a cross-sectional view of the pressure vessel of the exchanger of FIG. 1.

A pressure vessel 1 is provided with a first port 10 acting as a high pressure inlet of a first stream ("HP1 in") and a second port 11 acting as a high pressure outlet ("HP2 out"). The pressure vessel 1, shown in more detail in FIGS. 2 and 2*a*, includes three septum plates 12-14 attached thereto. The septum plates 12 and 13 are located towards either end of the vessel 1, and the plate 14 is located towards its centre.

Figure 3:
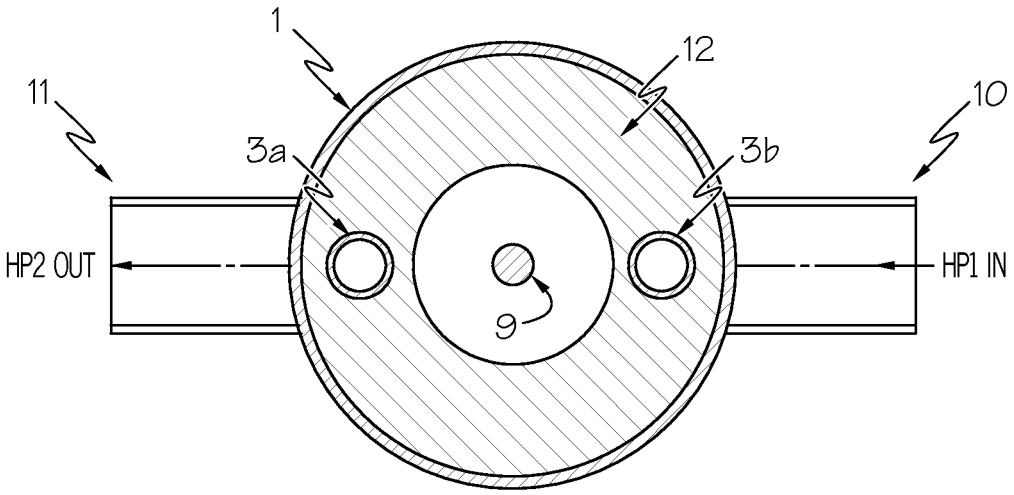
FIG. 3 is a cross-sectional view though line A-A of FIG. 1.

The three septum plates 12-14 of the pressure vessel 1 are bored out in substantially the same configuration as shown in FIG. 3, which shows the section A-A of FIG. 1. FIG. 3 also shows the two exchange ducts 3*a* and 3*b*, which are arranged around the outer ring of the septum plates.

Referring again to FIG. 1, duct pistons 4*a* and 4*b* are provided in the exchanger ducts 3*a* and 3*b*, respectively, to reduce mixing between the two fluid streams.

Sealingly installed through sealing surfaces S (also referred to as first sealing surfaces or first seal) at each end of the exchange ducts 3*a* and 3*b* and on the outside of septum plates 12 and 13 are flow distributors 5 and 6, which channel the flow individually of each exchange duct 3*a*, 3*b* radially towards the centre of the machine. The flow distributor 5 is illustrated in better detail in FIG. 4, which shows the section B-B of FIG. 1. The flow distributors 5, 6 have the net effect that there is a duct to/from the end of each exchange duct 3*a*, 3*b* to/from approximately the diameter of the valve element 9, as explained in further detail below.

The bottom of the pressure vessel 1 is sealed by the bottom sealing plate 8, which also incorporates port 15 for the low pressure stream outlet of the first stream ("LP1 out"). The bottom sealing plate 8 is secured and sealed to the pressure vessel 1.

Figure 5:
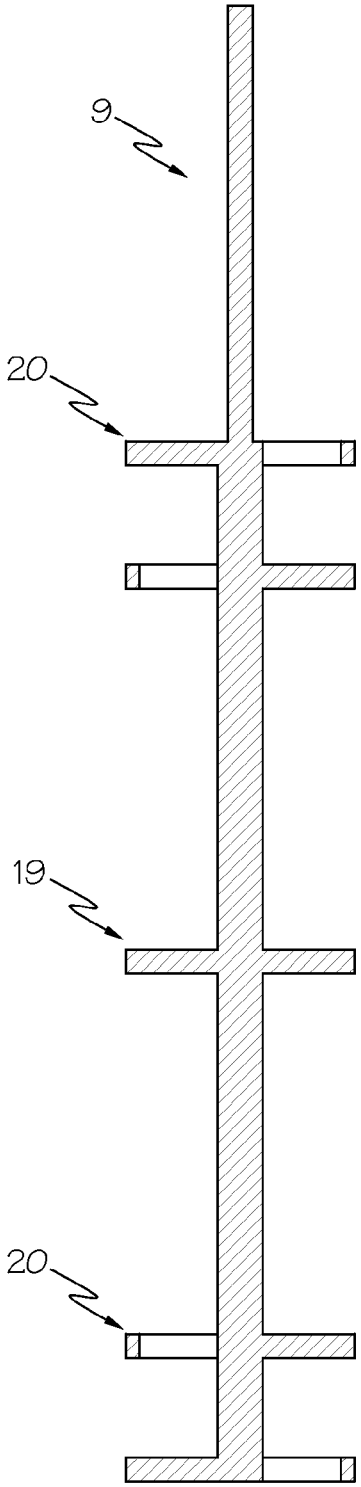
FIG. 5 is a cross-sectional view of the valve element of the exchanger of FIG. 1.
Figure 5A:
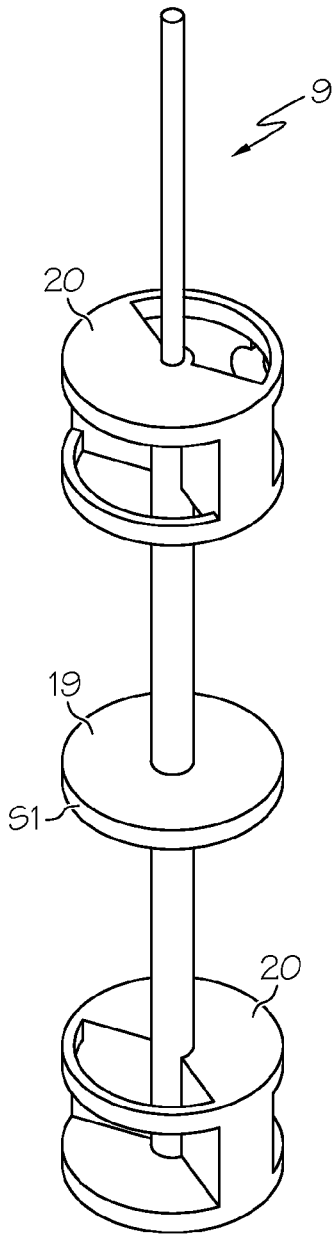
FIG. 5*a* is a perspective view of the valve element of FIG. 5.

Rotatable valve element 9 is located in the centre of the machine, that is along its longitudinal axis. Referring to FIGS. 5 and 5*a* in conjunction with FIG. 1, the valve element 9 includes a centre plate 19, which is utilized to separate high pressure streams "HP1 in" and "HP2 out", and incorporates a sealing surface 51 (also referred to as second sealing surface or second seal) on its outer perimeter, which rotatingly seals with the inner diameter of a complementary surface on the septum plate 14. It should be noted that in normal operation the pressure difference between the two high pressure streams is only the pressure drop in the high pressure portion of the machine, so this seal 51 has to cope with a relatively low pressure (for example, around 15 psi) differential rather than the relatively high (for example, up to around 1000 psi) pressure differential that sealing surfaces S are exposed to.

Figure 4:
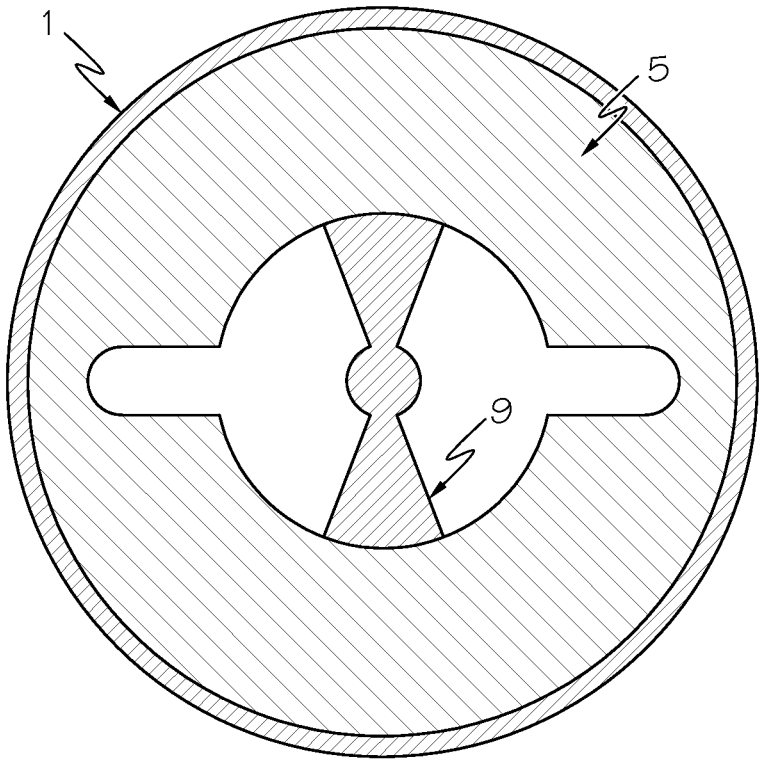
FIG. 4 is a cross-sectional view through line B-B of FIG. 1.

At each end of the valve element 9 are valves 20, of similar design to one another and each including two circular plates with partial circles cut out in the manner shown in FIG. 5*a*, and with an circumferential axial seal between the plates having a butterfly shape as shown in FIG. 4. The valves 20 ensure that as the valve element 9 rotates the exchange ducts 3*a* and 3*b* are either both isolated, or that one is exposed to high pressure while the other is exposed to low pressure. The outer perimeter of the valve elements 20 are provided with close clearance sealing surfaces, designated S in FIG. 1, similar to a wear ring utilized on centrifugal pump impellers.

As can be best seen in FIG. 1, the top of the pressure vessel 1 is sealed with a top sealing unit or plate 7, which also incorporates port 16 for the low pressure stream inlet of the second stream ("LP2 in"). There are also provided on the unit 7 a fluid seal and thrust bearing 18 for the valve element 9 shaft, as well as means for effecting rotation of the valve element 9, such as a coupling to an electric motor. The top sealing plate 7 is secured and sealed to the pressure vessel 1.

Figure 6:
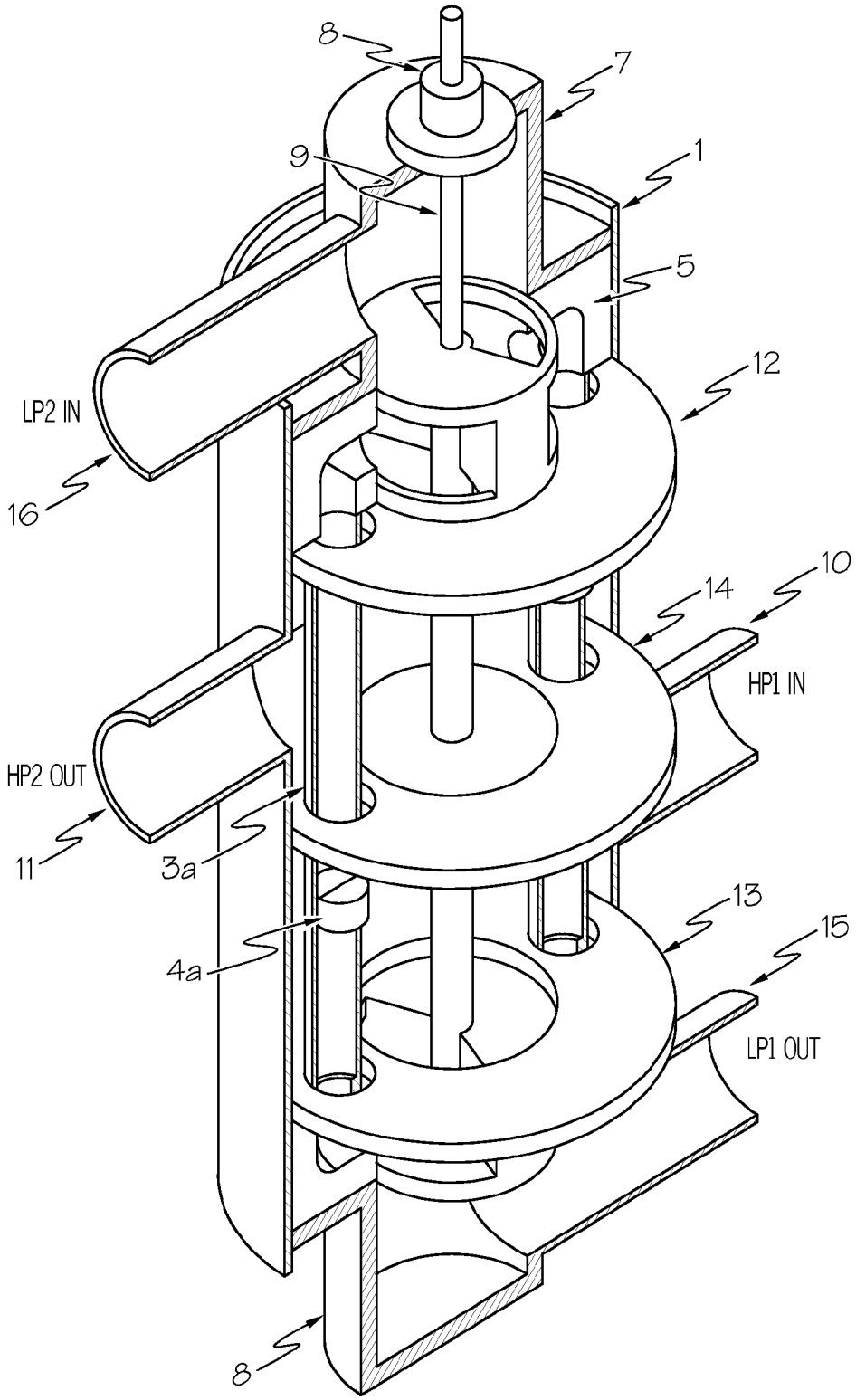
FIG. 6 is a perspective cutaway view of FIG. 1.

FIG. 6 shows a perspective cutaway drawing of the simplified embodiment of the exchanger shown in FIG. 1, serving better to illustrate the features disclosed above.

In operation, the "HP1 in" fluid stream is introduced to the machine at high pressure through port 10 and flows around the outside of the exchange duct 3*b* towards the centre of the machine. The stream then flows downwardly to the valve, where it then passes through the open ports of the valve element 9 and into the flow distributor 6. The stream then passes into and upwardly in the exchange duct 3*a*, causing upward displacement of the duct piston 4*a*, resulting in the pressurization and flow of the second fluid above the duct piston 4*a*.

The second fluid then flows into the upper flow distributor 5, into the valve element 9, and then downwardly and finally around the outside of the exchange duct 3*a* and out through the high pressure port 11, where it leaves as "HP2 out". Thus, the flow and pressure of "HP1 in" has been transferred to "HP2 out".

At the same time as the above is taking place, the "LP2 in" stream is introduced to the machine at low pressure through port 16. This flows into the valve element 9 and then into the flow distributor 5. From the flow distributor 5 it flows and downwardly into the exchange duct 3*b*, causing downward displacement of duct piston 4*b* and resulting in flow of the first fluid below the duct piston 4*b*, which then flows into the lower flow distributor 6, into the valve element 9, and then, out of the lower sealing plate 8 at port 15 for "LP1 out". Thus the flow and pressure of "LP2 in" has been transferred to "LP1 out" at low pressure.

As the valve element 9 rotates, first the exchange ducts 3*a* and 3*b* are both isolated at both ends, by the respective valve 20. Upon further rotation of the valve 20, the exchange ducts 3*a* and 3*b* are again opened to the flow, but exchange duct 3*a* operates at low pressure, with flow in the opposite direction, and exchange duct 3*b* operates at high pressure, in both cases with the flow in the opposite direction. Thus, by continued rotation, the pressure and flow of stream "HP1 in" is intermittent, but is transferred to the stream "HP2 out".

In operation, the pressure of stream "LP2 in" would be adjusted to ensure, as best as possible, that effectively all of stream "LP1 out" is displaced from the exchange ducts 3, by the duct pistons 4 hitting the flow distributor 6. In addition, the rotational speed of the valve element 9 would be adjusted to ensure, as best as possible, that the duct pistons 4 do not hit the flow distributor 6 before closing off, isolation and reversal of the flow.

It should be noted that the axial thrust on the valve element 9 is low, provided that the pressure drops on the high and low pressure flows are low. Thus, bearing 18 is not required to oppose a large amount of thrust.

The simplified embodiment described above provides a workable design, and well serves to teach the basis of the invention. However, it is preferred, in addition to the features of the simplified embodiments described above, to include one or more of the following features, which can result in a smoother operating and better balanced machine.

Figure 7A:
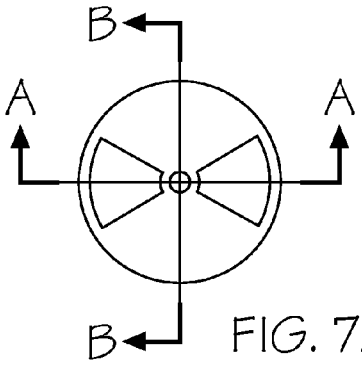
FIG. 7*a* is a cross-sectional view through the centre of one of the valve elements of FIG. 7.
Figure 7:
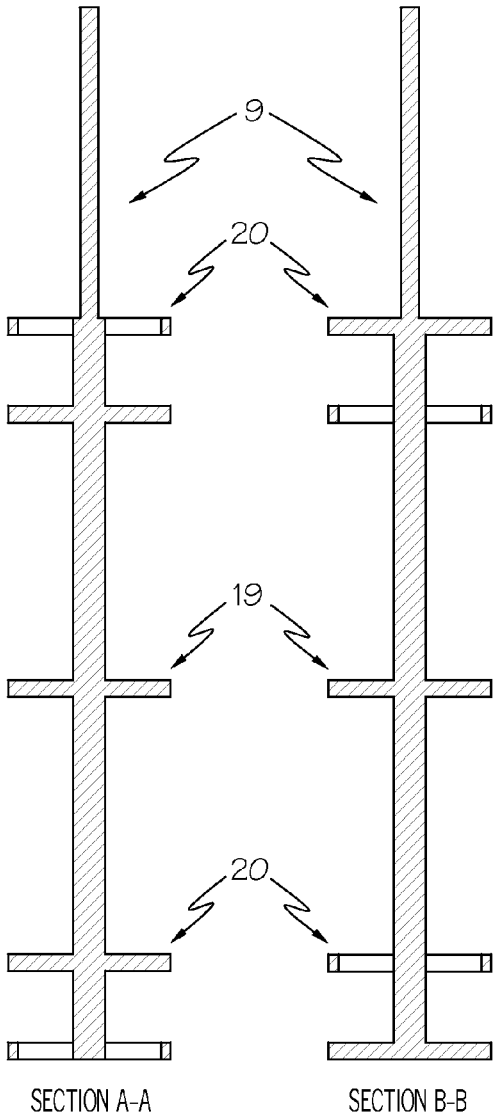
FIG. 7 is a cross-sectional view of a valve element of a preferred embodiment.
Figure 7B:
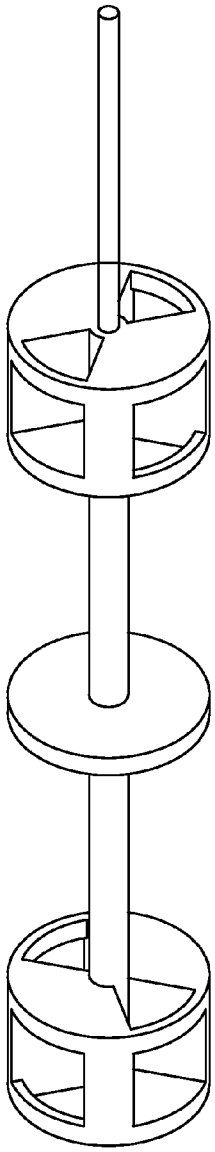
FIG. 7*b* is a perspective view of the valve element of FIG. 7.
Figure 8:
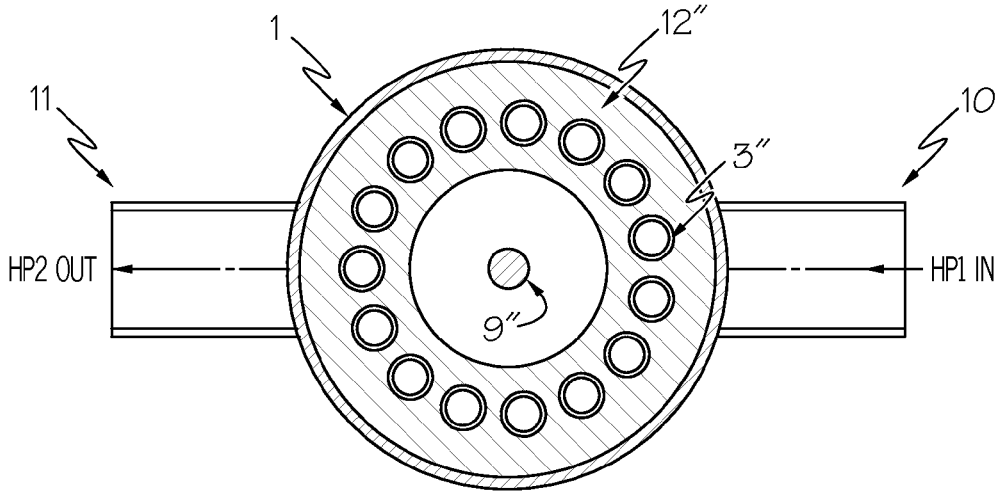
FIG. 8 is an equivalent preferred embodiment cross-sectional view though line A-A of FIG. 1.
Figure 9:
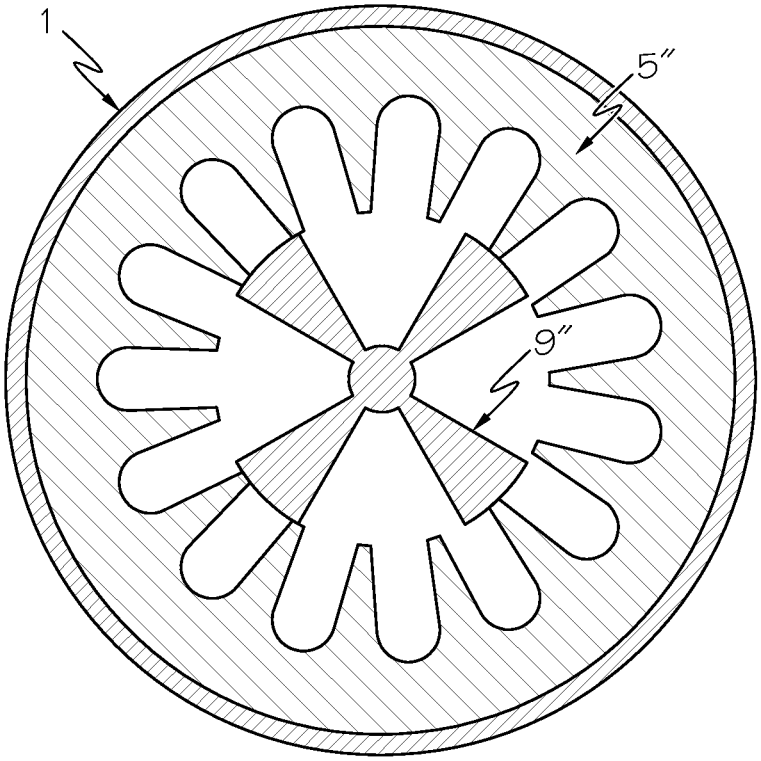
FIG. 9 is an equivalent preferred embodiment cross-sectional view through line B-B of FIG. 1.
Figure 10:
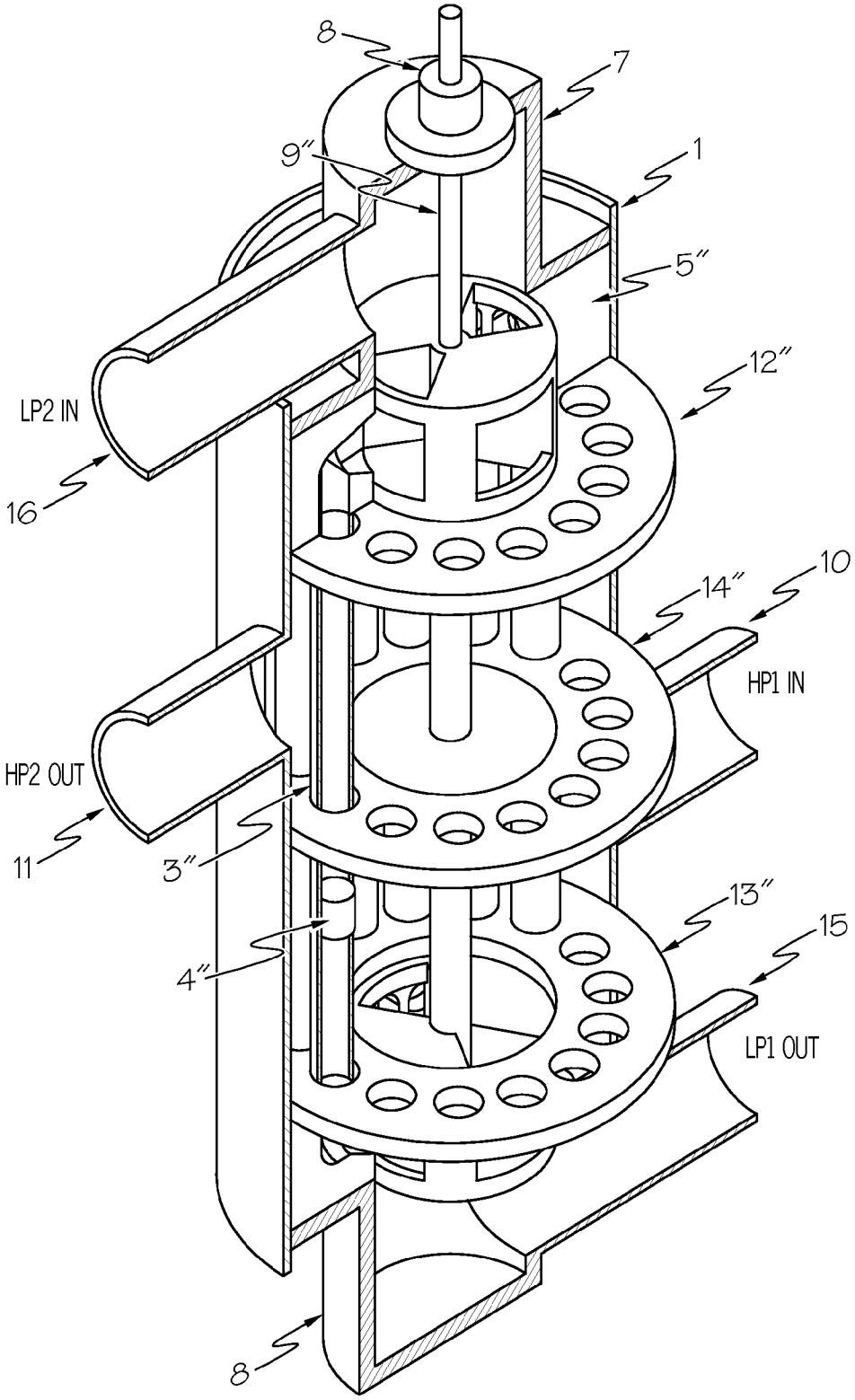
FIG. 10 is a perspective cutaway of a preferred embodiment of the exchanger.

The simplified embodiment described above incorporate valves 20 that have one segment of high pressure on one side and one segment of low pressure opposing it, which results in significant radial forces on the valves 20. To reduce such radial forces, the preferred embodiments would incorporate two segments of equal size of high pressure opposing one another, interspersed by two segments of equal size of low pressure opposing one another, as shown for the modified valve element 9' in FIGS. 7, 7*a* and 7*b*.

The simplified embodiment described above includes two exchange ducts 3, which results in both the high pressure and low pressure flow being restricted for part of the rotation of the valve element 9. The preferred embodiments would have more than two exchange ducts 3, such that neither the high pressure or low pressure flow are restricted as the valve element 9 rotates.

When utilizing the two opposing segments of both high pressure and low pressure in the valves 20 mentioned above, the preferred number of exchange ducts 3 is fifteen, as it results in exchange ducts 3 being closed and opened at different times, to result in a smoother operation, as shown in FIGS. 7 to 10. In these Figures the same reference numerals have been used to denote the equivalent components to the embodiment shown in FIGS. 1 to 6, appropriately suffixed in the case where a component has been modified to accommodate for fifteen exchange ducts.

It is to be understood that the teachings herein are not limited to the illustrations or preferred embodiments described, which are deemed to illustrate the best modes of carrying out these teachings, and which are susceptible to modification of form, size, arrangement of parts and details of operation.

The following are examples of such modifications that could be made to the preferred embodiments.

The high and low pressure port connection for each flow stream could be reversed, such that stream "HP1 in", "LP1 out", "HP2 in" and "LP2 out" are connected to ports 15, 10, 16 and 11, respectively.

The duct pistons 4 could be eliminated, which would result in more mixing between the two fluid streams, but would have implications of lower maintenance and noise.

The duct pistons 4 are shown in the preferred embodiments to be solid cylinders. Depending on the design of piping and equipment external to the machine, water hammer and/or excessive differential pressure across the duct pistons 4 could result when the pistons 4 reach the end of their stroke. To reduce this effect, the duct pistons 4 may have built into them orifices or a relief device for relieving trans-piston pressures or may be designed to enter into an area at the end of their stroke which allows bypassing of the fluid on the outside of the duct pistons 4.

The exchange ducts 3 are shown in the preferred embodiments to be circular, but they may be of other cross sectional shapes, such as oval or pie-shaped.

One of the preferred embodiments shows the exchange ducts 3 to be all located on the same radius from the centre of the machine but this is not necessary and a more compact machine may be achieved by having exchange ducts 3 on differing radii from the centre of the machine.

One of the preferred embodiments shows the valve element 9 as consisting of two valves 20 mounted on a common shaft. The same effect could be achieved by eliminating the common shaft and having each valve being a separate valve element with its own shaft protruding from the machine with separate but synchronized external rotating drives.

Figure 11:
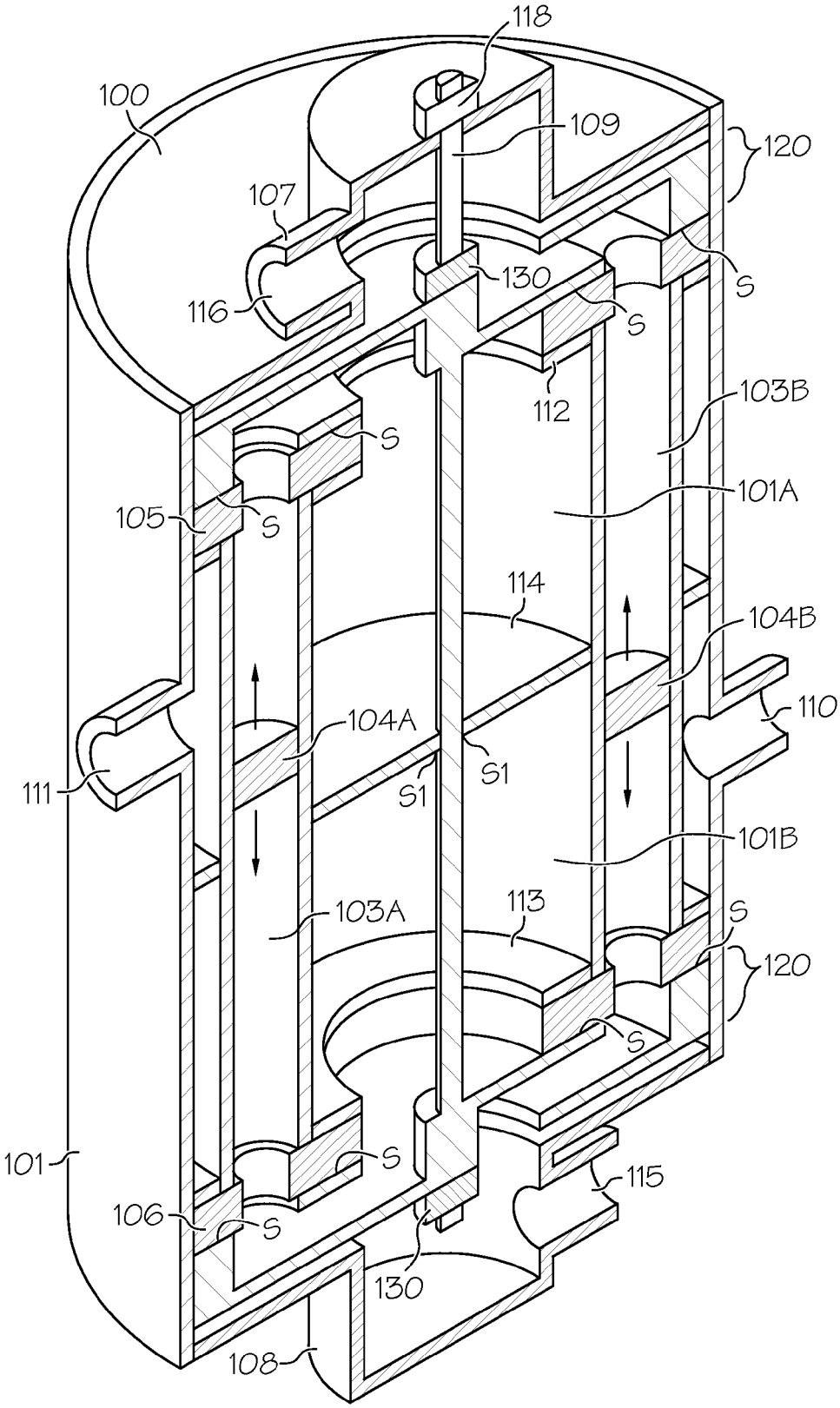
FIG. 11 is a perspective cutaway of another preferred embodiment of the exchanger with planar radial valve sealing surfaces.
Figure 12:
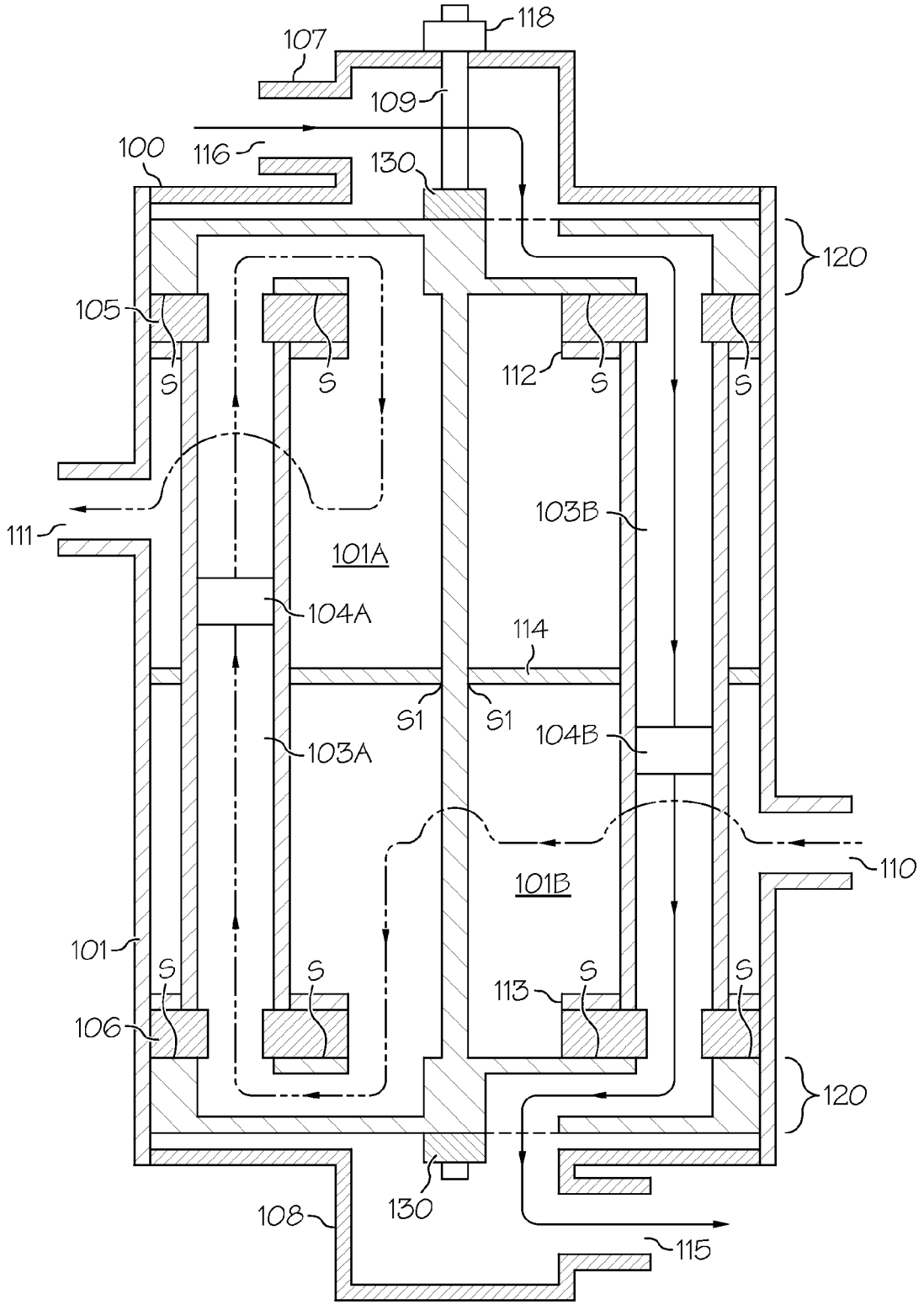
FIG. 12 is a cross-sectional view in simplified form of the exchanger of FIG. 11.

FIGS. 11 and 12 show another simplified embodiment, which is similar to that of FIG. 1, except that most (if not all) of the sealing surfaces S of the valves 120 are planar radial rather than circumferentially-oriented. The flow distributors 105 and 106 result in the flow from the ends of the exchange ducts 103A and 103B to the valves 120 being axial rather than radial. The inner planar radial surfaces of the valves 120 are the sealing surfaces that cooperate with the corresponding surfaces of the flow distributors 105 and 106. In addition, one or more adjusting nuts (also called adjusting mechanisms) 130 may be used to adjust the clearances of the planar radial sealing surfaces S. By the present configuration, the centre plate of valve element 9 of the embodiment depicted in FIG. 1 may be eliminated and the associated circumferential sealing surface 51 reduced in diameter relative to that of FIG. 1. In such case, valve assembly 109 can be accomplished by first inserting the common shaft, and then mounting valves 120 and adjusting nuts 130. As with the embodiment depicted in FIGS. 1 and 6, the top of the pressure vessel 100 depicted in FIGS. 11 and 12 is sealed with a top sealing unit 107 that incorporates port 116 for the low pressure stream inlet of the second stream. A fluid seal and thrust bearing 118 is used in a similar manner to that described above for connection of the valve element 109 shaft, where the top sealing unit 107 is secured and sealed to the pressure vessel. Further, the use of sealing surfaces S disposed between the valves 120 and the corresponding flow distributors 105 and 106, as well as the use of sealing surfaces S1 disposed between the septum plate 114 and the valve element 109, is shown.

Figure 13:
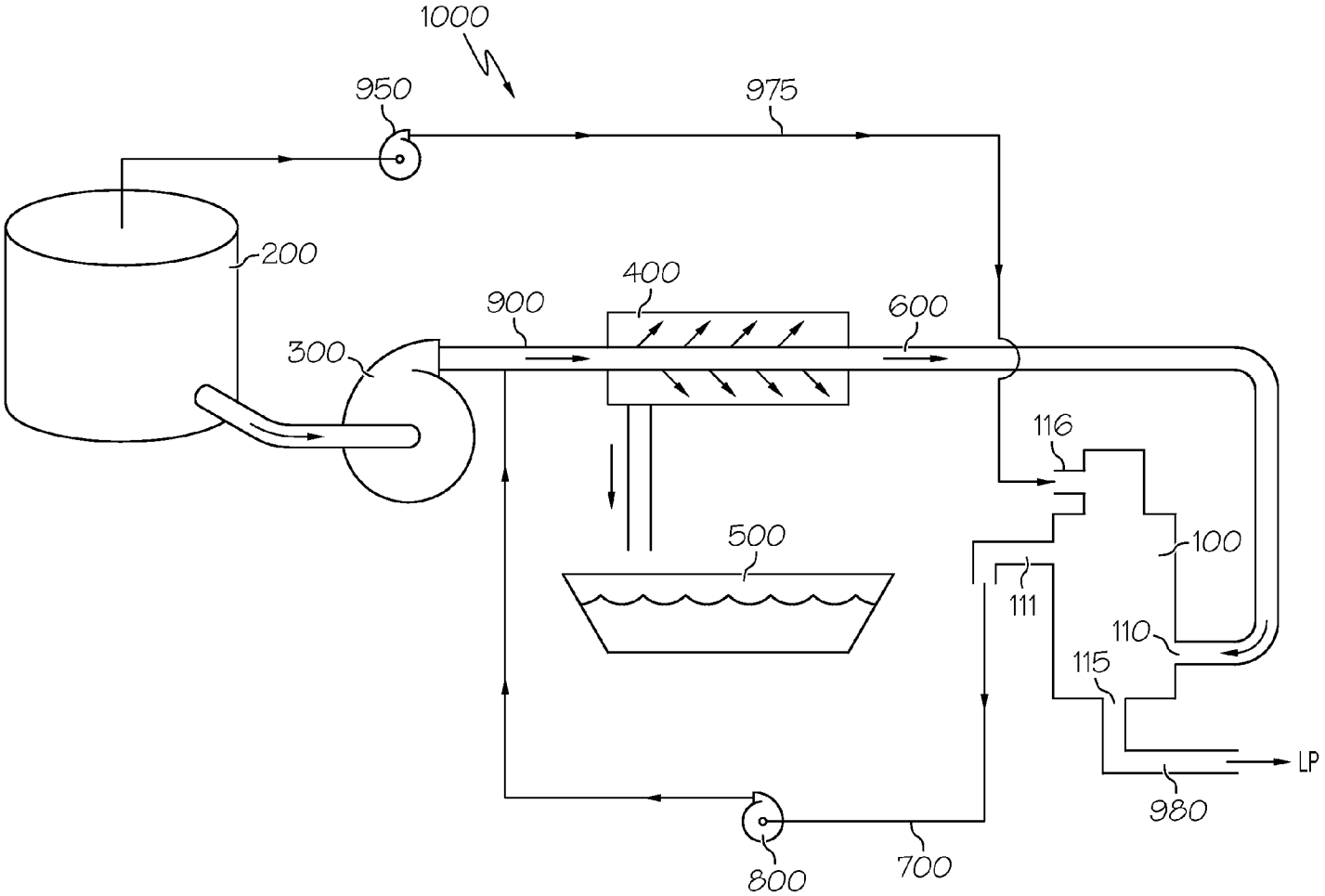
FIG. 13 is a simplified RO system employing the exchanger of FIGS. 11 and 12.

Referring with particularity to FIG. 13, an RO system 1000 includes, in addition to the pressure exchanger 100 of FIGS. 11 and 12, a saline water supply 200, high pressure feed pump 300 (also called a membrane feed pump), RO unit 400, permeate storage 500, retentate flow line 600 that feeds high pressure concentrated saline water (i.e. the retentate) into pressure exchanger 100, a recirculation line 700 that accepts high pressure saline water output from the pressure exchanger 100 and delivers it, with the assistance of a recirculation pump 800, into a pressurized line 900 downstream of high pressure feed pump 300. The recirculation pump 800 is sized to make up for the losses in pressure of the high pressure saline water that result from RO unit 400, as well as from the pressure exchanger 100. Concurrently, low pressure feed pump 950 delivers the saline water supply 200 via the low pressure feed line 975 to the pressure exchanger 100, displacing low pressure retentate to disposal 980. In one form, the saline water supply 200 may be a seawater supply, either directly from the body of water to which system 1000 is connected, or in the form of a seawater tank.

Referring again to FIGS. 11 and 12 in conjunction with FIG. 13, high pressure inlet 110 accepts high pressure retentate from the RO unit 400 while the high pressure outlet 111 delivers high pressure saline water to the recirculation line 700. Concurrently, low pressure inlet 116 accepts low pressure saline water from the low pressure line 975 while the low pressure outlet 115 delivers low pressure retentate to the retentate disposal line 980. During valve assembly 109 rotation, both ends of the pressure exchange ducts 103A, 103B are initially isolated by valves 120. Upon rotation of the valve assembly 109, when the valves 120 first open, pressure exchange duct 103A transitions from low to high pressure, and pressure exchange duct 103B transitions from high to low pressure. Upon further rotation of the valve assembly 109 to the position shown in FIGS. 11 and 12, the exchange ducts 103A, 103B are opened to the various flowpaths, where pressure exchange duct 103B receives low pressure saline water from low pressure inlet 116 displacing low pressure retentate to low pressure outlet 115, while pressure exchange duct 103A receives high pressure retentate from inlet 110 displacing high pressure saline water to high pressure outlet 111. Upon further valve assembly 109 rotation, both ends of the pressure exchange ducts 103A, 103B are isolated by valves 120. Upon further valve assembly 109 rotation, when the valves 120 first open, pressure exchange duct 103A transitions from high to low pressure, and pressure exchange duct 103B transitions from low to high pressure. Upon further rotation of the valve assembly 109, the exchange ducts 103A, 103B are again opened to the various flowpaths, where pressure exchange duct 103A receives low pressure saline water from low pressure inlet 116 displacing low pressure retentate to low pressure outlet 115, while pressure exchange duct 103B receives high pressure retentate from inlet 110 displacing high pressure saline water to high pressure outlet 111. Upon further rotation of the valve assembly 109, the valve 120 is at the initial position of isolation described above, and rotation continues. Thus, pressure exchanger 100 has an intermittent flow of low pressure saline water via low pressure inlet 116, and low pressure retentate out of low pressure outlet 115, and high pressure retentate into high pressure inlet 110, and high pressure saline water out of high pressure outlet 111. It will be appreciated by those skilled in the art that while the description contained herein is within the context of a two pressure exchange duct configuration, other configurations that employ other multiple duct configurations (i.e., a greater number of pressure exchange ducts) is also within the scope of the present invention and could provide more continuous, rather than intermittent, flows.

While many of the components of pressure exchanger 100, including the housing 101 with compartments 101A and 101B and fluid flowpaths with inlet and outlet ports 110, 111, 115 and 116, as well as the rotating valve assembly 109 and pressure exchange ducts 103A and 103B with flow separating pistons 104A and 104B disposed therein function in a manner generally similar to that of the device disclosed in the '917 publication, the device depicted in FIGS. 11 and 12 includes changes to the way various rotational components are sealed. Specifically, sealing surfaces S, which may be small clearance or include individual sealing components, are located between substantially planar radial surfaces of valves 120 and the flow distributors 105, 106. This configuration differs from that depicted in the '917 publication in that the sealing surfaces S are, rather than located on a generally circumferential interface between the outer face of the valves 20 and a corresponding inner face of the flow distributors 5, 6, situated axially relative to one another such that they produce a flat sealing interface between adjacent planar surfaces of the valves 120 and the flow distributors 105, 106. In this way, a very small clearance promotes tight sealing.

Referring with particularity to FIG. 12, in addition to providing a substantially planar sealing surface S, the configuration of the present invention facilitates ease of maintenance, as any foreign particle that becomes lodged between the flow distributors 105, 106 and the valves 120 can be easily cleared away by axial removal of the valve assembly 109 being held in place by adjusting nuts 130. Another advantage of the present invention is that the planar sealing surfaces S could be solid, clad, coated or otherwise overlaid in a suitable material that is very flat, eliminating the use of sealing components and having a relatively low leakage, with adjustment of the sealing clearance being made with adjusting nuts 130. In one form, such a material could be ceramic, which is very strong, resistant to wear and corrosion and can be fabricated accurately in a very flat form. Such a planar thin film seal has the benefit that it can act as a hydrostatic or hydrodynamic axial thrust bearing as well. Such a configuration would be advantageous in that it could allow for the elimination of external thrust bearings. An additional advantage of the present invention is that the clearance between the sealing surfaces S can be changed by adjusting nuts 130. An additional advantage of the present invention is that the diameter of the rotating seal 51 in the middle of rotating valve assembly 109 that interfaces between the common shaft of valve assembly 109 and septum 114 can be reduced. Still another advantage of the present invention is that the outer circumference of the valves 120 can be manufactured with a close tolerance. Such a construction would have the effect of making the valve assembly 109 act, such as through close cooperation with an inner wall of the housing 101 or related structure, as a centering bearing.

What is claimed is:

1. A pressure exchanger machine comprising:

a housing defining a pressure vessel with first and second compartments and inlet and outlet flow connections;

a plurality of exchange ducts statically mounted within said housing;

a plurality of valves rotatably disposed within said housing and configured to establish selective fluid communication between said plurality of exchange ducts and at least one of said inlet and outlet flow connections such that during said fluid communication, high or low pressure flows pass through at least one of said first and second compartments and at least one of said plurality of exchange ducts, wherein a first valve of said plurality of valves is operable to direct flow to or from a first end of said exchange ducts and a second valve of said plurality of valves is operable to direct flow to or from a second end of said exchange ducts, wherein each of said first and second valves define an opening formed therein that alternatively connects to respective ends of said exchange ducts; and a first seal disposed between at least one valve of said plurality of valves and a face of said plurality of exchange ducts such that at least one sealing surface is formed between their respective adjacently-facing substantially planar surfaces.

2. The machine of claim 1, further comprising an adjusting mechanism such that upon actuation thereof, clearance between said at least one sealing surface and said at least one valve can be adjusted.

3. The machine of claim 2, wherein said adjusting mechanism comprises an adjusting nut cooperative with said at least one valve such that upon turning said adjusting nut, said at least one valve moves in an axial direction relative to an adjacent one of said at least one sealing surface to adjust the clearance between them.

4. The machine of claim 1, wherein said each of said face of said plurality of exchange ducts is formed from a flow distributor.

5. The device of claim 1, wherein said at least one sealing surface produces a lower coefficient of friction between said at least one valve and said pressure exchange ducts than if said sealing surface were not present.

6. The device of claim 1, wherein said at least one sealing surface comprises a ceramic material.

7. The device of claim 1, further comprising a second seal radially disposed between said at least one valve and a plurality of adjacent pressurized fluid compartments such that a sealing surface is formed therebetween.

8. A reverse osmosis system incorporating the device of claim 1.

9. A method of operating at least one planarly-sealed valve in a pressure exchanger machine, said method comprising:

configuring said machine to include a plurality of rotatably disposed valves used to establish selective fluid communication between a plurality of exchange ducts to allow pressurized fluid to pass through first and second compartments and inlet and outlet flow connections within said machine, wherein a first valve of said plurality of valves is operable to direct flow to or from a first end of said exchange ducts and a second valve of said plurality of valves is operable to direct flow to or from a second end of said exchange ducts, wherein each of said first and second valves define an opening formed therein that alternatively connects to respective ends of said exchange ducts;

forming a substantially planar first seal between at least one rotatably disposed valve of said plurality of rotatably disposed valves and at least one of said plurality of exchange ducts, said first and second compartments or a flow distributor; and rotating said at least one rotatably disposed valve in said pressure exchange device relative to said at least one of said plurality of exchange ducts and said first and second compartments so that said pressure exchange ducts and said first and second compartments facilitate pressure exchange between a high pressure fluid and a low pressure fluid resident in said machine while said at least one rotatably disposed valve maintains said substantially planar first seal.

10. The method of claim 9, wherein said plurality of exchange ducts are fixed within a housing of said machine.

11. The method of claim 9, wherein said substantially planar first seal includes a ceramic material formed thereon.

12. The method of claim 9, further comprising adjusting a clearance of said substantially planar first seal.

13. The method of claim 12, wherein said adjusting a clearance comprises adjusting a nut formed on said at least one rotatably disposed valve.

14. The method of claim 9, wherein said first valve and said second valve are axially spaced from one another along a common shaft.

15. The method of claim 9, wherein said substantially planar first seal is formed on a substantially planar surface of said at least one rotatably disposed valve and an adjacently-facing surface of said flow distributor that is rigidly affixed to at least one of said plurality of exchange ducts and said first and second compartments.

* * * * *

UNITED STATES PATENT AND TRADEMARK OFFICE

CERTIFICATE OF CORRECTION

PATENT NO. : 8,622,714 B2
APPLICATION NO. : 13/079038
DATED : January 7, 2014
INVENTOR(S) : William T. Andrews It is certified that error appears in the above-identified patent and that said Letters Patent is hereby corrected as shown below:

In the Specification

Col. 5, Line 32,
"sealing surface 51 (also referred to as second sealing surface" should read
--sealing surface S1 (also referred to as second sealing surface--;

Col. 5, Line 38,
"machine, so this seal 51 has to cope with a relatively low" should read
--machine, so this seal S1 has to cope with a relatively low--;

Col. 7, Line 64,
"ing surface 51 reduced in diameter relative to that of FIG. 1." should read
--ing surface S1 reduced in diameter relative to that of FIG. 1.--; and Col. 9, Line 56,
"51 in the middle of rotating valve assembly 109 that interfaces" should read
--S1 in the middle of rotating valve assembly 109 that interfaces--.

Signed and Sealed this
Twenty-second Day of September, 2015

Michelle K. Lee

Michelle K. Lee
*Director of the United States Patent and Trademark Office*